US008099913B1

(12) United States Patent
Dodd

(10) Patent No.: US 8,099,913 B1
(45) Date of Patent: Jan. 24, 2012

(54) WHEELED TRUSS CONVERTIBLE TO A TRUSS WITH CATWALK

(75) Inventor: Mark C. Dodd, Pendleton, IN (US)

(73) Assignee: Tyler Truss Systems, Inc., Pendleton, IN (US)

( * ) Notice: Subject to any disclaimer, the term of this patent is extended or adjusted under 35 U.S.C. 154(b) by 201 days.

(21) Appl. No.: 12/502,617

(22) Filed: Jul. 14, 2009

Related U.S. Application Data

(63) Continuation of application No. 12/206,178, filed on Sep. 8, 2008, now abandoned.

(51) Int. Cl.
*E04B 1/34* (2006.01)

(52) U.S. Cl. ..... 52/143; 52/650.3; 52/79.5; 182/150

(58) Field of Classification Search ..... 52/143, 52/650.1, 6, 633, 638, 637, 641, 645, 650.3, 52/651.1, 64, 174, 79.5; 182/150, 222; 362/220, 362/249.01, 368, 430, 457; 248/129, 911, 248/912; 280/30, 47.35, 79.3, 33.998
See application file for complete search history.

(56) References Cited

U.S. PATENT DOCUMENTS

| | | | | | |
|---|---|---|---|---|---|
| 2,070,334 | A * | 2/1937 | Garber | 362/253 |
| 3,735,951 | A * | 5/1973 | Reed | 248/340 |
| 4,749,060 | A * | 6/1988 | Vandelinde | 182/222 |
| 4,837,665 | A * | 6/1989 | Hoyer et al. | 362/96 |
| 4,862,336 | A * | 8/1989 | Richardson et al. | 362/285 |
| 5,121,812 | A * | 6/1992 | Ochiai et al. | 182/152 |
| 5,237,792 | A * | 8/1993 | Oberman et al. | 52/645 |
| 5,335,468 | A * | 8/1994 | Oberman et al. | 52/645 |
| 5,361,565 | A * | 11/1994 | Bayer | 254/292 |
| 5,579,866 | A * | 12/1996 | Rowell | 182/150 |
| 5,617,931 | A * | 4/1997 | Zygmun et al. | 182/145 |
| 5,653,457 | A * | 8/1997 | Marmer et al. | 280/30 |
| 5,993,030 | A * | 11/1999 | Barcel | 362/408 |
| 6,026,626 | A * | 2/2000 | Fisher | 52/633 |
| 6,675,546 | B2 * | 1/2004 | Coles | 52/655.1 |
| 7,219,765 | B2 * | 5/2007 | Gierss | 182/150 |
| 2010/0064624 | A1 * | 3/2010 | Dodd | 52/646 |

* cited by examiner

*Primary Examiner* — Basil Katcheves
*Assistant Examiner* — Branon Painter
(74) *Attorney, Agent, or Firm* — Woodard Emhardt Moriarty McNett + Henry LLP

(57) ABSTRACT

A wheeled truss that is convertible into a truss with a catwalk. A carriage is removably mounted to the bottom of the truss for transporting the truss to the performance site. The carriage is removed from the truss, inverted and mounted to the top of the truss forming with the truss a catwalk.

20 Claims, 7 Drawing Sheets

WHEELED TRUSS CONVERTIBLE TO A TRUSS WITH CATWALK

REFERENCE TO RELATED APPLICATIONS

This application is a continuation of U.S. patent application Ser. No. 12/206,178, filed Sep. 8, 2008, now abandoned, which is hereby incorporated by reference.

BACKGROUND OF THE INVENTION

1. Field of the Invention

The present invention relates generally to the field of trusses and more specifically trusses used to hold a variety of appliances, such as overhead lights.

2. Description of the Prior Art

Various staging systems are used in the production and managing of events of every shape and size including all types of entertainment, such as, concerts, dance, theatre, comedy, etc. Typically, large scale truss assemblies support, above the staging area, the lighting fixtures used during the performance.

Light fixtures that are expensive and difficult to handle are assembled to the truss at various locations. It is desirable to provide a truss having a light fixture already mounted thereto before the truss is transported to the staging area; however, damage to the light fixture may occur if the truss is not appropriately handled during the transportation state. By placing the truss having the light fixture mounted thereto on a cart and wheeling the cart to the staging area can result in damage thereby increasing the expense and delaying the installation. Further, a minimum amount of time is available to erect the truss system and it is therefore desirable to place the light fixture on the truss prior to transportation. Disclosed herein is a combined truss and carriage designed to fit together as a single assembly thereby providing for a reliable assembly for transporting the light fixture mounted to the truss. Once at the staging site, the truss may be lifted upwardly with the light fixture and removed from the carriage.

It is necessary to provide access to the trusses and attached light fixtures as well as other appliances that may be attached to the trusses even though the trusses are located relatively high above the ground or stage. It is difficult to walk above the trusses unless some type of a catwalk is provided. The carriage for the truss disclosed herein may be removed from beneath the truss, inverted and then remounted atop the truss providing a structure that extends upwardly from the truss. The structure includes a pair of spaced apart members that extend the length of the structure forming guard rails enabling personnel to walk atop the truss while holding on to the guard rails of the carriage. A catwalk is therefore formed. Upon disassembly of the entire truss system, the truss with carriage mounted thereatop may be lowered, the carriage removed from atop the truss and reinstalled beneath the truss thereby allowing the truss assembly to be quickly moved from the staging area. As a result, the truss and carriage disclosed herein provides not only a quick means for assembly and disassembly of the entire truss assembly thereby decreasing the cost of the installation but at the same time increasing the safety of the personnel that are walking above the trusses for assembly, disassembly and maintenance procedures.

SUMMARY OF THE INVENTION

On embodiment of the present invention is a truss assembly that is convertible from a wheeled truss to a truss with a catwalk and back to a wheeled truss including a carriage with ground engageable wheels rotatably mounted thereon. A truss is removably mounted atop the carriage for transportation of the truss. The carriage includes side portions that serve as guard rails for a person walking atop the truss when the carriage is removed from beneath the truss and re-mounted thereatop in an invested state.

It is an object of the present invention to provide a new and improved truss.

A further object of the present invention is to provide a truss having a carriage for transporting the truss to and from the staging area.

Yet another object of the present invention is to provide a truss assembly having a catwalk above the truss upon which the installation and maintenance personnel may walk.

Related objects and advantageous of the present invention will be apparent from the following description.

DESCRIPTION OF THE PREFERRED EMBODIMENT

Figure 2:
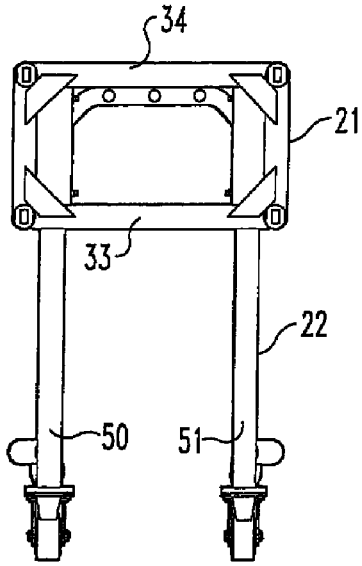
FIG. 2 is a left end view of the truss of FIG. 1.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1:
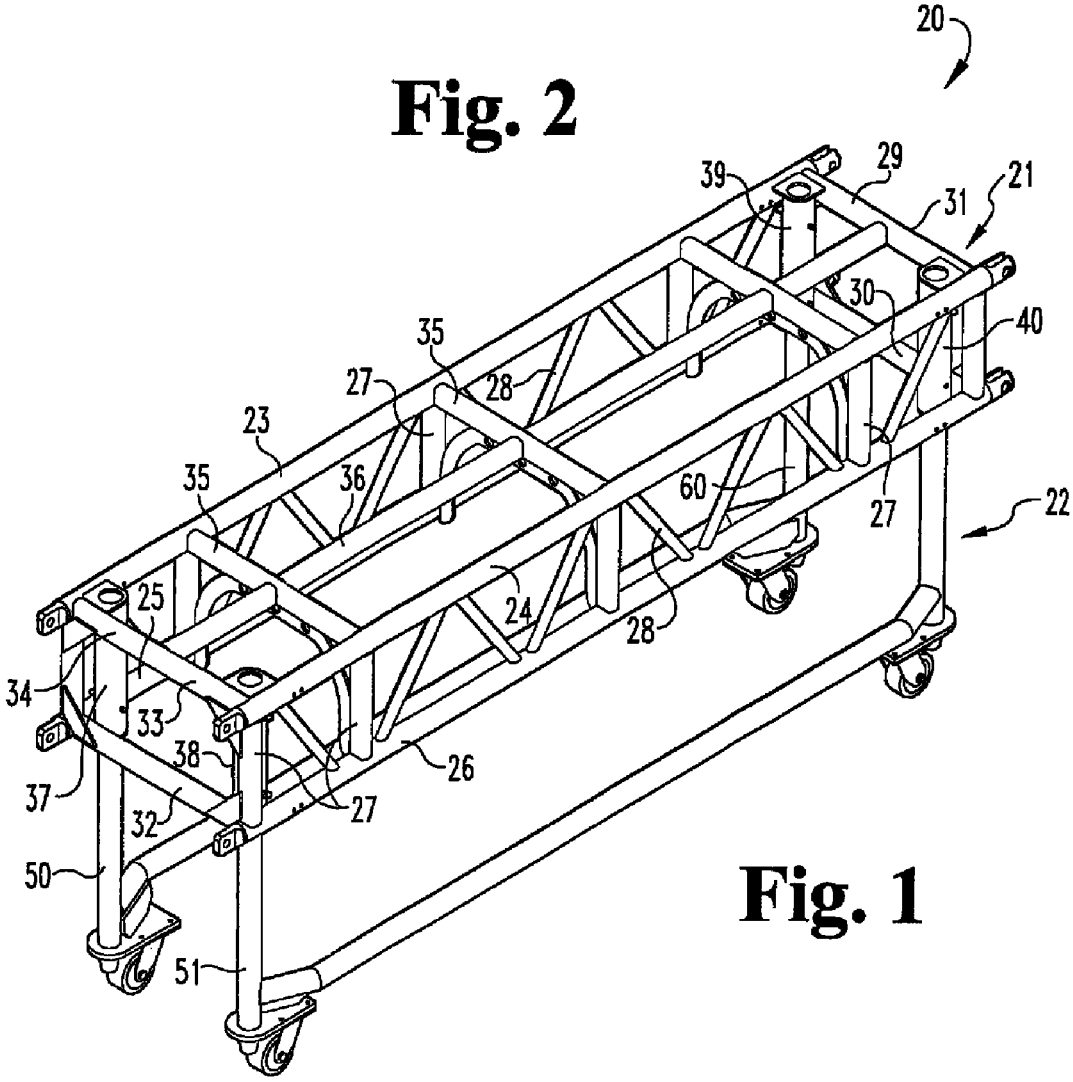
FIG. 1 is a perspective view of a truss assembly incorporating the present invention having a truss removably mounted atop a carriage.
Figure 3:
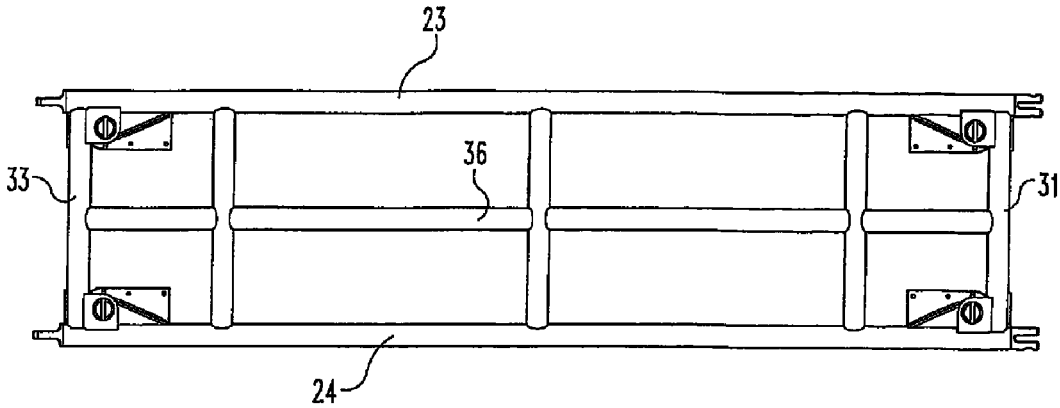
FIG. 3 is a top view of the truss of FIG. 1.
Figure 6:
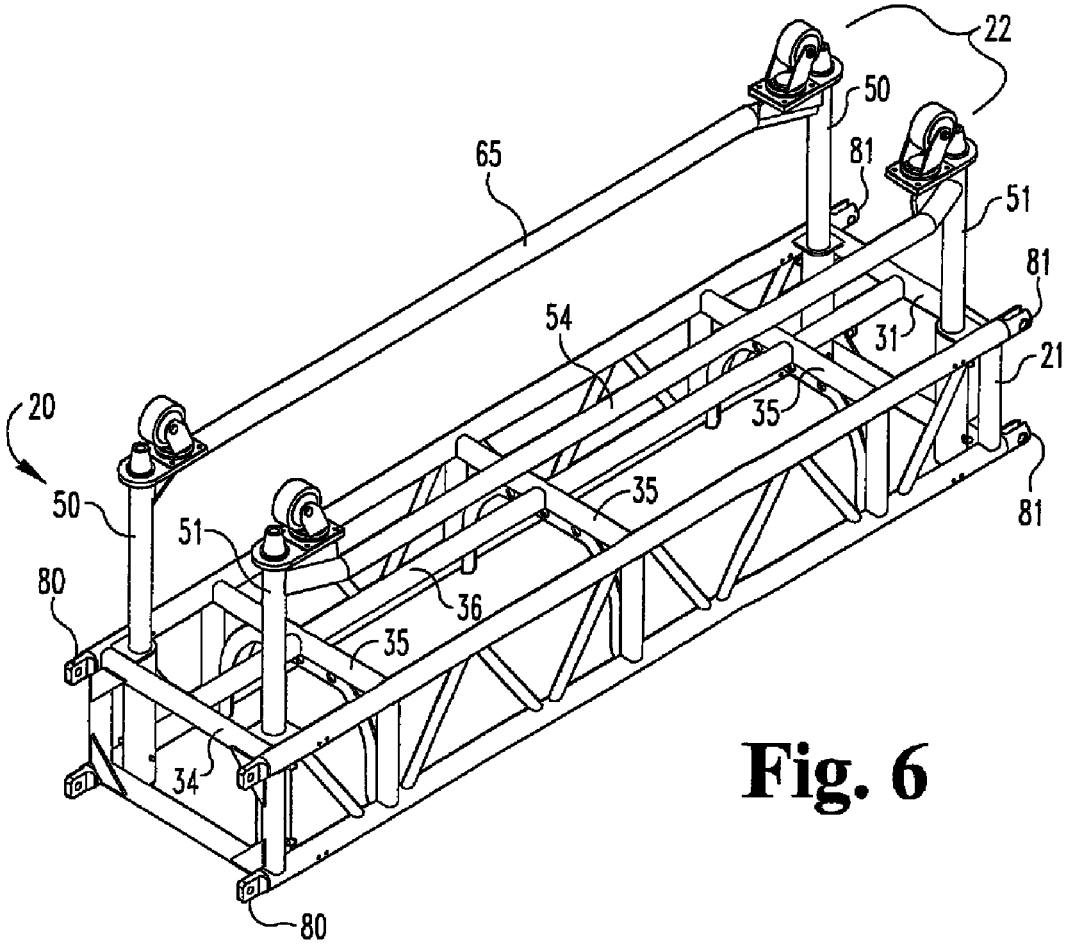
FIG. 6 is the same view as FIG. 1 only showing the carriage in an inverted position mounted atop the carriage and forming a catwalk.
Figure 9:
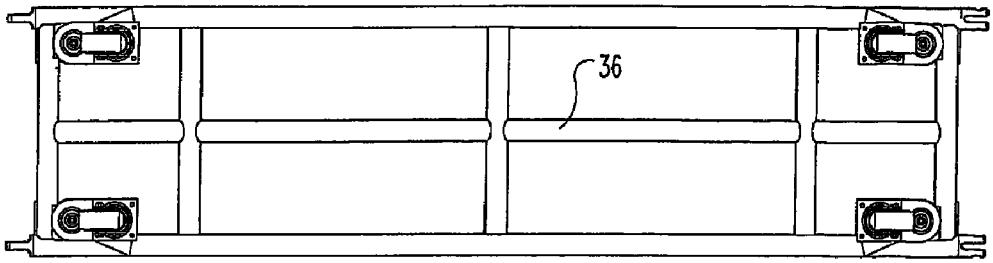
FIG. 9 is a top view of the truss of FIG. 6.
Figure 8:
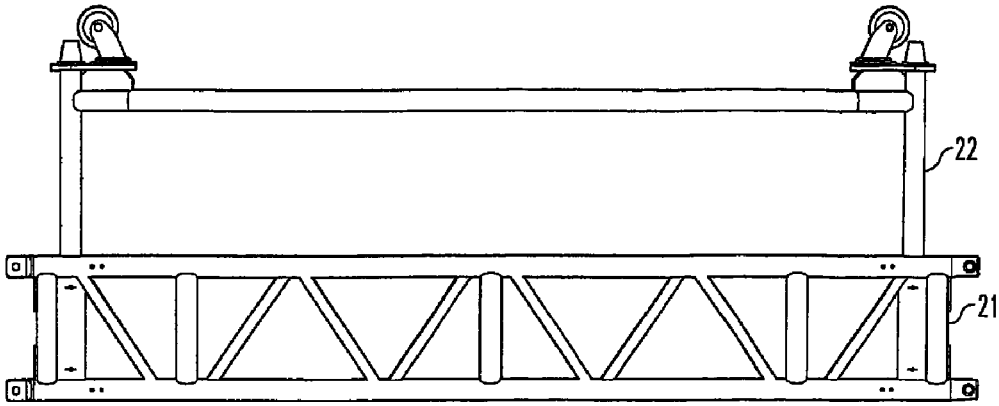
FIG. 8 is a side view of the truss of FIG. 6.

Referring now more particularly to FIGS. 1 and 6, the preferred embodiment of the truss assembly is shown respectively with the carriage of the truss assembly mounted beneath the truss and mounted atop the truss. In FIG. 1, truss assembly 20 has a truss 21 removably mounted atop carriage 22. Truss 21 has a pair of tubular, spaced apart and parallel side members 23 and 24 positioned above a pair of tubular, spaced apart and parallel side members 25 and 26. A plurality of vertical tubular members 27 have bottom ends integrally attached to tubular members 25 and 26 and top ends integrally attached to tubular members 23 and 24. A plurality of diagonal members 28 also have bottom ends integrally attached to tubular members 25 and 26 and top ends integrally attached to tubular members 23 and 24 thereby providing a unified truss 21. A pair of end cross tubes 30 and 31 extend between and are integrally attached respectively to members 25, 26 and 23, 24 at end 29 of the truss. Likewise, a pair of tubular cross tubes 32 and 33 extend between and are integrally attached respectively to tubes 25, 26 and 23, 24 at end 34 of the truss.

The top of truss 21 has a plurality of tubular cross members 35 extending between and integrally attached to side members 23 and 24. Tubular member 36 is spaced equidistant between tubes 23 and 24 with its opposite ends attached to members 31 and 33 with member 36 also connected to cross members 35. The bottom of truss 21 is open and is not provided with any cross member 35 or member 36. That is, the space between members 30, 32 and 25, 26 is void. As a result, various appliances (FIG. 11), such as lights, may be suspendedly mounted to members 35, 36 with the lights extending downward between members 30, 32 and 25, 26 with the lights not being restricted in position by any structure.

Figure 4:
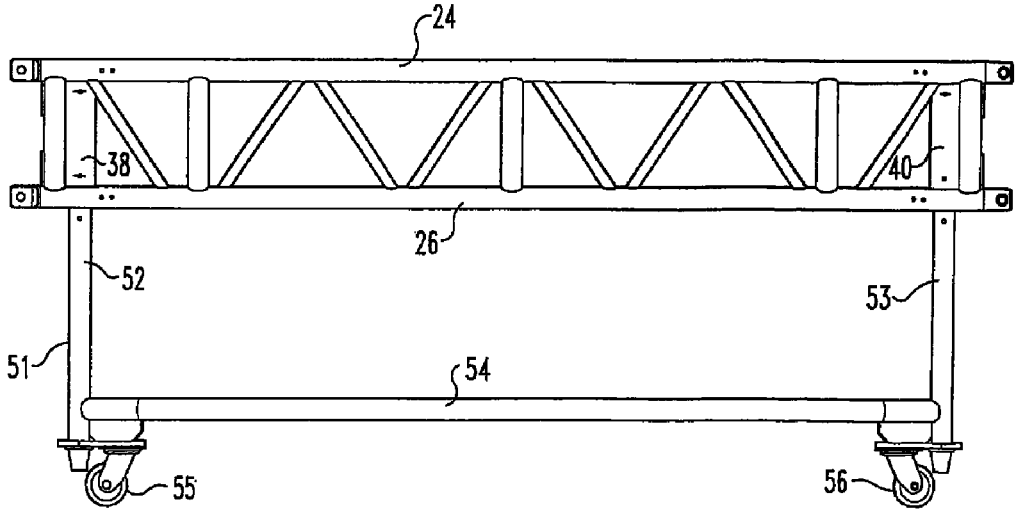
FIG. 4 is a side view of the truss of FIG. 1.

Carriage 22 includes a pair of identically constructed u-shaped frames 50 and 51. Frame 51 will now be described it being understood an identical description applies to frame 50. Frame 51 includes a pair of vertically extending tubular members 52 and 53 (FIG. 4) having bottom ends integrally attached to the opposite ends of tubular member 54 that extends the length of the carriage. A pair of standard commercially available castor wheels 55 and 56 are rotatably and pivotally mounted to the bottom of frame 51. U-shaped frame 50 likewise includes a pair of upwardly extending tubular members integrally attached to the opposite ends of a tubular member extending the length of the carriage. A pair of castor wheels are rotatably and pivotally mounted to the bottom of frame 50. Frames 50 and 51 are not connected to each other except by truss 21 when the frames are mounted to truss 21.

Four mounting sleeves 37-40 (FIG. 1) are integrally attached to the opposite ends of truss 21 and receive the vertically extending members of frames 50 and 51. Tubes 37 and 38 extend vertically and have their opposite ends attached respectively to members 23, 25 and 24, 26 at end 34 of the truss. Likewise, sleeves 39 and 40 have their opposite ends attached respectively to tubes 23, 25, and 24, 26 at end 29. Sleeves 37-40 have open tops and open bottoms to receive the vertically extending members of frames 50 and 51 depending upon whether the carriage is in the transporting state shown in FIG. 1 or the inverted, end use state shown in FIG. 6.

Figure 5:
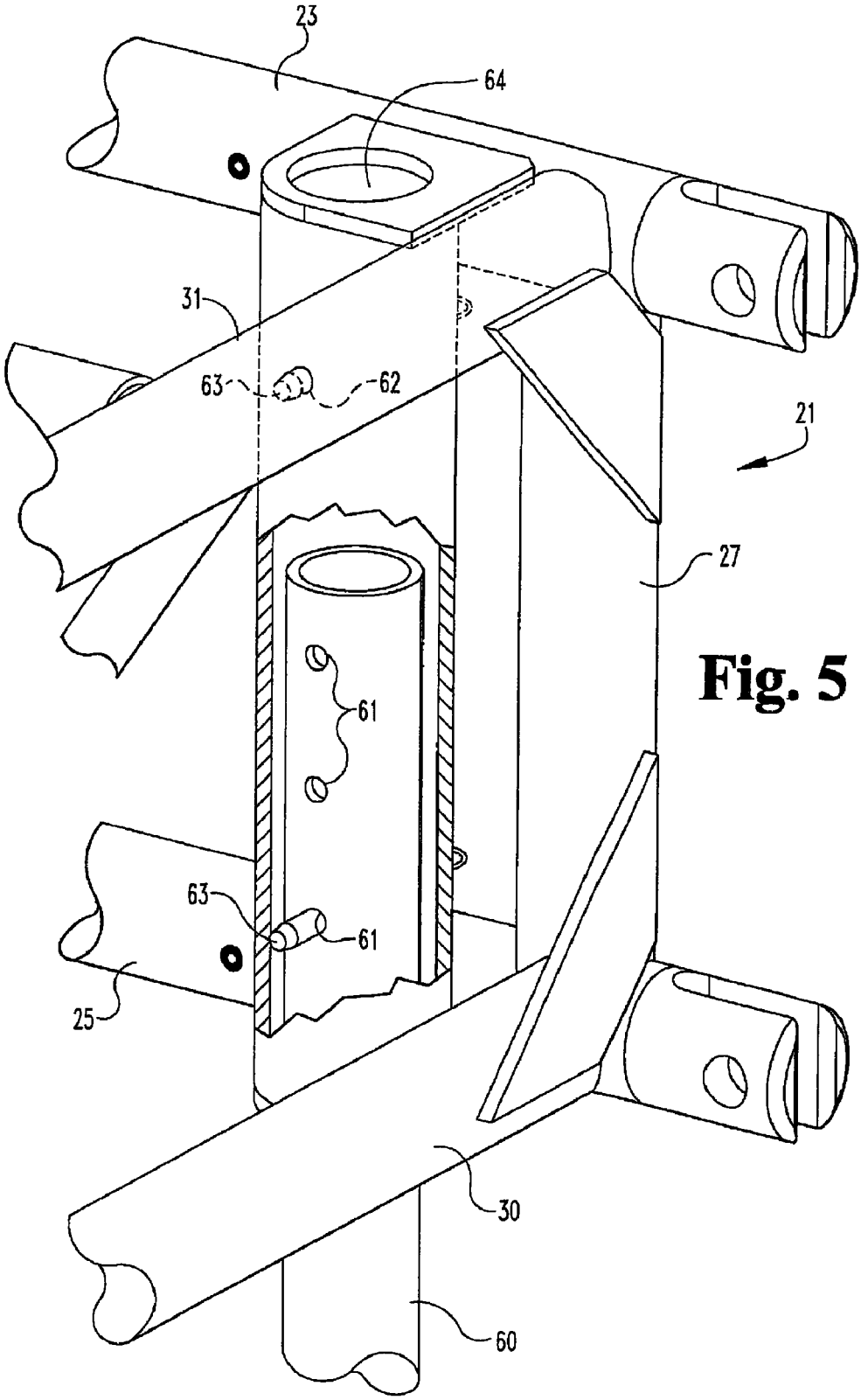
FIG. 5 is a fragmentary, enlarged, perspective view of the female end of the truss of FIG. 1.
Figure 7:
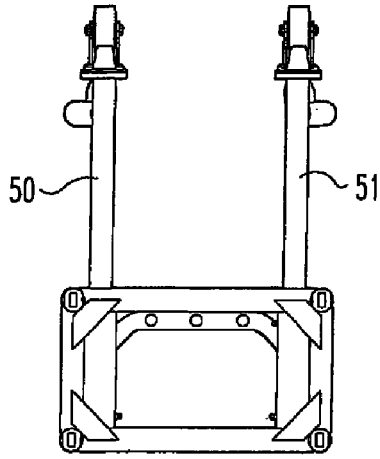
FIG. 7 is a left end view of the truss of FIG. 6.

FIG. 5 is a fragmentary view showing a cutaway section of sleeve 39 illustrating the mounting of the carriage frame 50 to truss 21 when in the transporting state. The vertically extending member 60 of u-shaped frame 50 extends upwardly into sleeve 39 and has a plurality of apertures 61 extending through member 60 with at least one of the apertures 61 of member 60 being alignable with one of the apertures 62 extending completely through tube 39 enabling a conventional mounting pin 63 to be extended through sleeve 39 and member 60 removably locking the truss and carriage frame 50 together. Likewise, the opposite end of frame 50 includes an upwardly extending member that extends upwardly into sleeve 37 having apertures alignable with apertures in sleeve 37 receiving mounting pins extending there through to mount the u-shaped frame 50 to the truss. Similarly, the upwardly extending members 52 and 53 (FIG. 4) of frame 51 extend upwardly into sleeves 38 and 40 and are pinned to the sleeves thereby securing u-shaped frame 51 of the carriage to truss 21.

With the carriage, consisting of the separate frames 50 and 51, mounted to and beneath truss 21, the truss assembly 20 is wheeled to the performance site, such as a stage. Once in place on the stage floor, truss 21 is lifted upwardly while pins 63 are removed thereby allowing u-shaped frames 50 and 51 of the carriage to disengage truss 21. The carriage 22 is then inverted by separately inverting u-shaped frames 50 and 51 with the vertically extending members of each u-shape frame then being extended downwardly into the top 64 (FIG. 5) of each sleeve positioning the carriage above the truss as illustrated in FIG. 6. The wheels are therefore above the truss. With carriage 22 then positioned atop truss 21 (FIG. 6) and with the carriage vertical members pinned to the truss sleeves, the entire truss assembly is then lifted into place above the performance area or stage floor. A catwalk is therefore formed consisting of the members 54 and 65, extending the length of the inverted u-shaped frames 51 and 50, and the crosswise extending members 35 and lengthwise extending member 36 integrally attached to the top of truss 21. Members 35 and 36 form a walkable area upon which the maintenance and installation personnel may walk whereas members 54 and 65 provide guardrails extending the length of the truss assembly.

Figure 10:
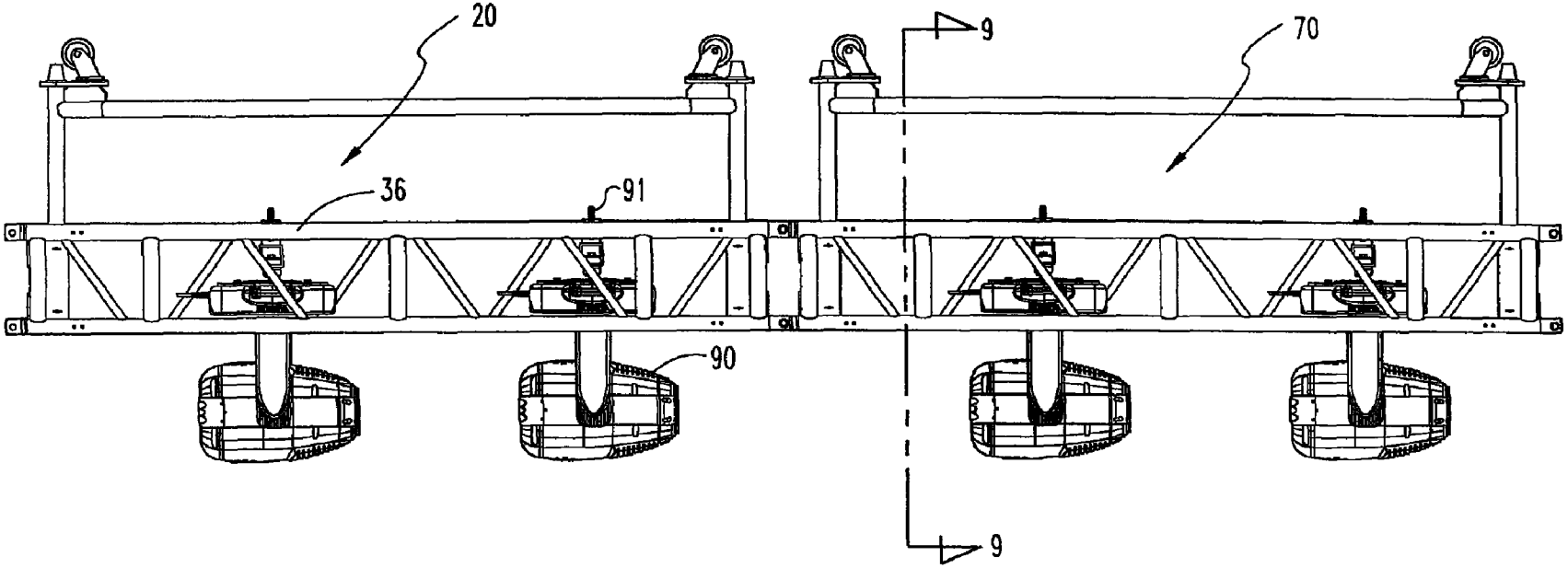
FIG. 10 is a perspective view of two truss assemblies connected together with lights mounted thereto and with the carriage positioned atop the truss.

Truss 21 includes four male extension plates 80 mounted to the end 34 of truss 21 and four female extensions 81 (FIG. 6) mounted to the end 29 of the truss. Male members 80 (FIG. 6) of truss 21 may be inserted between the mutually opposed plates of each female extension 81 on an adjacent truss identical to truss 21. Male members 80 and female members 81 have aligned apertures to receive pins extending there through releasably locking one truss to an adjacent truss. Thus, a plurality of truss assemblies may be connected together forming a plurality of trusses connected together as well as a catwalk consisting of a plurality of aligned catwalks. As shown in FIG. 10, a pair of identical truss assemblies 20 and 70 are connected together by means of the male and female extensions.

Figure 11:
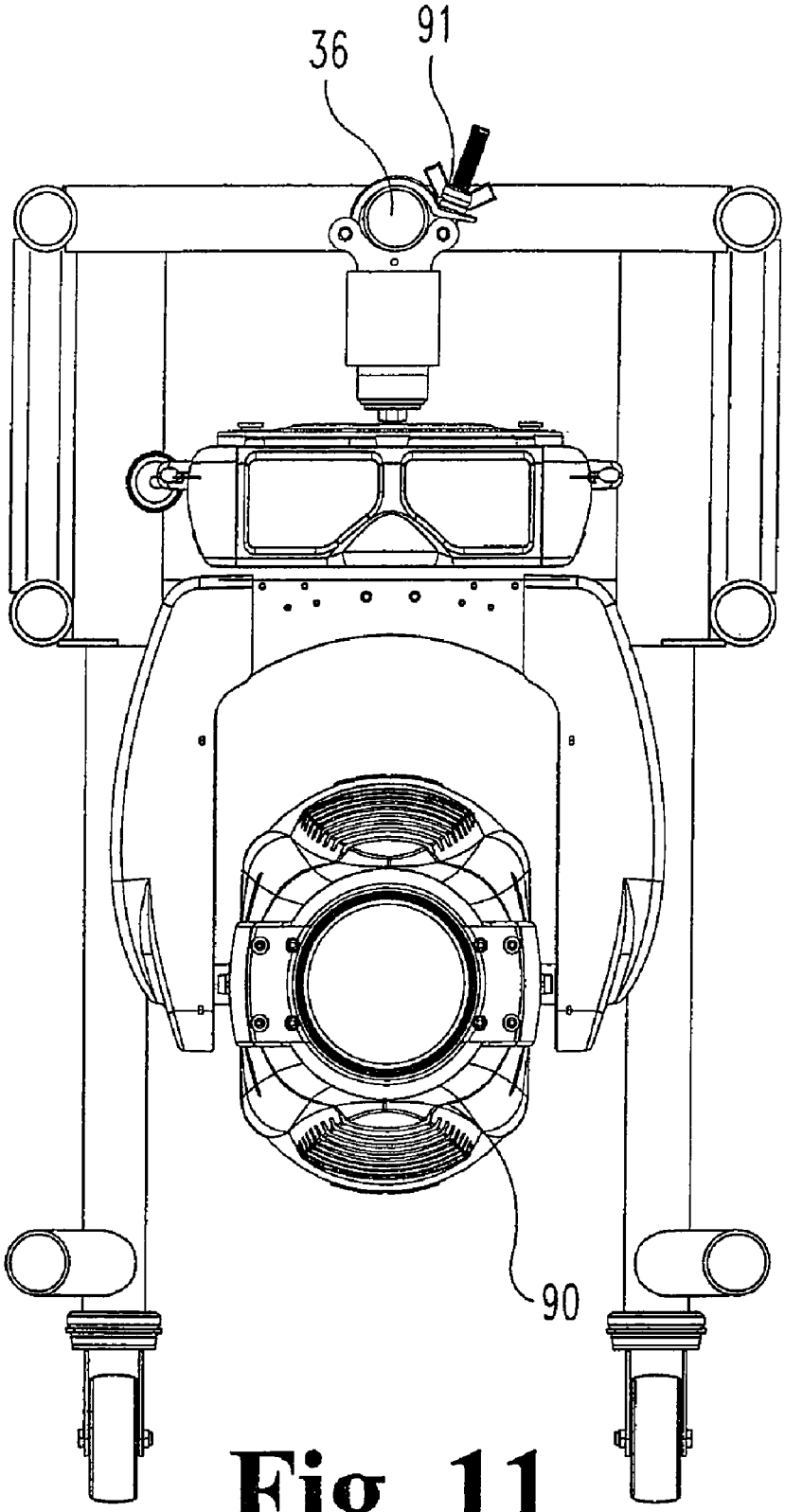
FIG. 11 is a fragmentary, cross sectional view showing a light mounted to a truss with the carriage positioned beneath the truss.

A variety of appliances, such as lights, speakers, etc. may be suspendedly mounted to the truss prior to the lifting of the truss assembly into place. Further, the appliances may be mounted to each individual truss prior to transportation of the truss assembly to the performance site. The appliances, such as the lights, have been left off of the illustrations of FIGS. 1-8 in order to more clearly illustrate the carriage and connected truss. FIG. 11 is a cross-sectional view of truss 21 illustrating a conventional appliance, such as a light 90 removably mounted to member 36 by a conventional C clamp 91. The light 90 extends downwardly through the bottom of truss 21 which is opened and not blocked by any cross members. When the truss is mounted atop the carriage, the light 90 extends down into the carriage between frames 50 and 51 and is protected by the frames during transportation. Once the carriage is removed from the truss, inverted and remounted atop the truss, the lights and appliances hang beneath the truss.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A wheeled truss for holding an appliance and being convertible to a truss with a catwalk comprising:

a first truss for holding an appliance including a top end forming a walkable support and a bottom end; and, a supporting frame having a first end portion with wheels thereon with said first end portion further including a first guard rail and a second guard rail, said frame further having an opposite end portion with said opposite end portion engageable with said bottom end of said first truss for transporting and supporting said first truss as said first truss and frame are moved on said wheels, said opposite end portion engageable with said top end of said first truss when said frame is disconnected, separated and removed from beneath said first truss, inverted, located above, and reconnected to said truss with said first guard rail, said second guard rail, and walkable support cooperatively forming a catwalk above said frame; and wherein:

said first truss and said supporting frame includes an interlocking mechanism comprising sleeves and extended members, with said extended members insertable into said sleeves at said bottom end when said frame is beneath said first truss and insertable into said sleeves at said top end when said frame is above said first truss with said sleeves and said extended members providing support for said supporting frame when located above said first truss; wherein said wheels extend downwardly from said supporting frame when said supporting frame is beneath said first truss but extend upwardly from said supporting frame when said supporting frame is inverted and mounted atop said first truss.

2. A wheeled truss for holding an appliance and being convertible to a truss with a catwalk comprising:

a first truss for holding an appliance including a top end forming a walkable support and a bottom end; and, a supporting frame having a first end portion with wheels thereon with said first end portion further including a first guard rail and a second guard rail, said frame further having an opposite end portion with said opposite end portion engageable with said bottom end of said first truss for transporting and supporting said first truss as said first truss and frame are moved on said wheels, said opposite end portion engageable with said top end of said first truss when said frame is disconnected, separated and removed from beneath said first truss, inverted, located above, and reconnected to said truss with said first guard rail, said second guard rail, and walkable support cooperatively forming a catwalk above said frame; and wherein:

said first truss and said supporting frame includes an interlocking mechanism comprising sleeves and extended members, with said extended members insertable into said sleeves at said bottom end when said frame is beneath said first truss and insertable into said sleeves at said top end when said frame is above said first truss with said sleeves and said extended members providing support for said supporting frame when located above said first truss; wherein said wheels extend downwardly from said supporting frame when said supporting frame is beneath said first truss but extend upwardly from said supporting frame when said supporting frame is inverted and mounted atop said first truss.

3. The truss of claim 2 wherein:

said first truss including ends with lock components thereon capable of interlocking with other trusses alignable therewith to form an extended catwalk above said trusses.

4. The truss of claim 2 and further comprising:

a light appliance mounted to said first truss and extending into said supporting frame between said first guard rail and said second guard rail for protection of said light appliance as said first truss is moved on said wheels to direct light downwardly from said truss.

5. The truss of claim 4 wherein:

said first truss includes opposite tubular spaced apart side portions and cross members located at said top end that are connected to said side portions and secure said side portions together, said cross members forming said walkable support, said appliance is mounted at said top end and is suspended therefrom extending downwardly through the bottom end of said first truss which is open.

6. The truss of claim 4 wherein:

a said second guard rail is spaced apart from said first guard rail with said first guard rail and said second guard rail including tubular members extending longitudinally on said supporting frame between said sleeves.

7. A truss comprising:

a truss structure with side portions and cross members connected together in a unified structure; and, a carriage with wheels having a portion engageable with said truss structure when said carriage is located beneath said truss structure allowing said truss structure to be supported by said carriage and moved on said wheels, said portion of said carriage separable and dis-engageable from said truss structure and then invertible and re-engageable with said truss structure when said carriage is located above said truss structure; and wherein:

said portion of said carriage and said truss structure having an interlocking mechanism comprising interlocking extended members and sleeves that removably connect said carriage and said truss structure together, said extended members insertable into said sleeves when said carriage is beneath said truss structure and also when said carriage is above said truss structure with said sleeves and said extended members providing support for said carriage when located above said truss structure forming a catwalk; wherein said wheels extend downwardly from said carriage when said carriage is beneath said truss structure but extend upwardly from said carriage when said carriage is inverted and mounted atop said truss structure.

8. The truss of claim 7 and further comprising:

a plurality of lights mounted and suspended from said truss structure, said lights extending into said carriage when said truss structure is atop said carriage and extending beneath said truss structure and said carriage when said carriage is atop said truss structure.

9. The truss of claim 8 wherein:

said carriage includes sides extending along the length of said carriage forming guard rails when positioned atop said truss structure.

10. The truss of claim 9 wherein:

said cross members form a support upon which a person can walk on and cooperatively with said guard rails when positioned atop said truss structure form said catwalk.

11. The truss of claim 10 wherein said truss structure includes a first end with male locks thereon and a second opposite end with female locks thereon to allow a plurality of truss structures to be ganged together by interlocking male locks and female locks together of adjacent truss structures while forming an extended catwalk above said plurality of truss structures.

12. The truss of claim 7 and further comprising:

a light mounted to said truss structure and extending downwardly therefrom and into said carriage when said carriage is mounted to and beneath said truss structure protecting said light during transportation thereof with said light extending beneath said truss structure out in the open when said carriage is removed from beneath said truss structure and mounted atop said truss structure.

13. The truss assembly of claim 12 wherein:

said carriage and said truss have interlocking extended members and sleeves to removably connect said carriage and said truss together, said extended members insertable into said sleeves when said carriage is beneath said truss and also when said carriage is above said truss with said sleeves and said extended members providing support for said carriage when located above said truss structure forming a catwalk and when located beneath said truss structure for moving said truss structure on said wheels.

14. A truss assembly that is convertible from a wheeled truss to a truss with a catwalk and back to a wheeled truss comprising:

a carriage with ground engageable wheels rotatably mounted thereon, said carriage includes a first and second spaced apart side frame with said first side frame having a first proximal end and a first distal end and said second side frame having a second proximal end and a second distal end, said first side frame includes first wheels rotatably mounted to said first distal end and said second side frame includes second wheels rotatable mounted to said second distal end; and, a first truss removably mounted atop said carriage for transportation of said first truss, said side frames serving as side guards for a person walking atop said carriage when removed from beneath said first truss and re-mounted thereatop, said first side frame with said first wheels is removable from beneath said first truss and mounted atop said first truss while said second side frame with said second wheels is mounted beneath said first truss which is then removable from beneath said first truss and installed thereatop; wherein said wheels extend downwardly from said carriage when said carriage is beneath said first truss but extend upwardly from said carriage when said carriage is inverted and mounted atop said first truss.

15. The truss assembly of claim 14 wherein:

said first truss has upper frame portions to support a person walking on said first truss between said first and second side frames of said carriage with said upper frame portions and said side frames forming a catwalk.

16. The truss assembly of claim 15 wherein:

said carriage and said first truss have tubes and sleeves that are engageable with each other for releasably holding said carriage and said first truss together when said carriage is beneath said first truss and when said carriage is atop said first truss.

17. The truss assembly of claim 16 wherein:

said first truss includes spaced apart sides and cross portions connected to said spaced apart sides, said first truss has an open bottom and a partially closed top whereat said cross portions extend forming a walkable area, and further comprising a light removably mounted to said first truss at said top and extends downwardly through said open bottom, said cross portions and said side portions form a catwalk.

18. The truss assembly of claim 14 and further comprising:

a light mounted to said first truss and extending downwardly therefrom and into said carriage when said carriage is mounted to and beneath said first truss protecting said light during transportation thereof with said light extending beneath said first truss out in the open when said carriage is removed from beneath said first truss and mounted atop said first truss.

19. A truss assembly that is convertible from a wheeled truss to a truss with a catwalk and back to a wheeled truss comprising:

a carriage with ground engageable wheels rotatably mounted thereon;

a first truss removably mounted atop said carriage for transportation of said first truss, said carriage including side portions that serve as side guards for a person walking atop said carriage when removed from beneath said first truss and re-mounted thereatop;

said first truss has upper frame portions to support a person walking on said first truss between said side portions of said carriage with said upper frame portions and said side portions forming a catwalk;

said carriage and said first truss have tubes and sleeves that are engageable with each other for releasably holding said carriage and said first truss together when said carriage is beneath said first truss and when said carriage is atop said first truss;

said first truss includes spaced apart sides and cross portions connected to said spaced apart sides, said first truss has an open bottom and a partially closed top whereat said cross portions extend forming a walkable area, and further comprising a light removably mounted to said first truss at said top and extends downwardly through said open bottom, said cross portions and said side portions form a catwalk; and said wheels extend downwardly from said carriage when said carriage is beneath said first truss but extend upwardly from said carriage when said carriage is inverted and mounted atop said first truss.

20. The truss assembly of claim 19 wherein:

said carriage has a separate first frame and second frame each with vertically extending members and a horizontally extending member with opposite ends attached to said vertically extending members.

* * * * *